US010385682B2

(12) United States Patent
Nieuwoudt et al.

(10) Patent No.: US 10,385,682 B2
(45) Date of Patent: Aug. 20, 2019

(54) PIPE CONVEYED LOGGING AND DRILL PIPE COMMUNICATION INTEGRATION SYSTEM AND METHOD

(71) Applicants: Hermanus J. Nieuwoudt, Tomball, TX (US); Daniel A. Funes, The Woodlands, TX (US)

(72) Inventors: Hermanus J. Nieuwoudt, Tomball, TX (US); Daniel A. Funes, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 160 days.

(21) Appl. No.: 15/237,262

(22) Filed: Aug. 15, 2016

(65) Prior Publication Data

US 2018/0045038 A1 Feb. 15, 2018

(51) Int. Cl.

| | |
|---|---|
| ***E21B 47/12*** | (2012.01) |
| ***E21B 17/00*** | (2006.01) |
| ***E21B 17/02*** | (2006.01) |
| ***E21B 47/16*** | (2006.01) |
| ***E21B 47/18*** | (2012.01) |

(52) U.S. Cl.

CPC ..... *E21B 47/12* (2013.01); *E21B 17/003* (2013.01); *E21B 17/028* (2013.01); *E21B 47/16* (2013.01); *E21B 47/18* (2013.01)

(58) Field of Classification Search

CPC ..... E21B 47/12; E21B 47/18; E21B 47/16; E21B 17/003; E21B 17/028

See application file for complete search history.

(56) References Cited

U.S. PATENT DOCUMENTS

| | | | | |
|---|---|---|---|---|
| 4,799,546 | A | 1/1989 | Hensley et al. | |
| 5,389,003 | A | 2/1995 | Van Steenwyk et al. | |
| 6,717,501 | B2 | 4/2004 | Hall et al. | |
| 7,537,061 | B2 | 5/2009 | Hall et al. | |
| 8,136,591 | B2 | 3/2012 | Del Campo et al. | |
| 8,544,534 | B2 | 10/2013 | Partouche et al. | |
| 8,654,832 | B1 | 2/2014 | Hansen et al. | |
| 8,689,867 | B2 | 4/2014 | MacDougall et al. | |
| 8,704,677 | B2 | 4/2014 | Prammer | |
| 8,941,384 | B2 | 1/2015 | Prammer | |
| 2007/0023191 | A1* | 2/2007 | Dreggevik | E21B 17/023 166/377 |
| 2007/0044959 | A1 | 3/2007 | Georgi | |
| 2007/0284099 | A1* | 12/2007 | DiFoggio | E21B 49/08 166/264 |
| 2008/0149348 | A1* | 6/2008 | DiFoggio | E21B 23/00 166/381 |
| 2010/0170673 | A1 | 7/2010 | Krueger et al. | |
| 2014/0174762 | A1 | 6/2014 | MacDougall et al. | |
| 2014/0266772 | A1* | 9/2014 | Walton | E21B 47/122 340/854.8 |
| 2014/0291015 | A1 | 10/2014 | Floerke et al. | |
| 2015/0061885 | A1 | 3/2015 | Mueller et al. | |
| 2015/0204155 | A1* | 7/2015 | Patel | E21B 33/124 166/360 |

* cited by examiner

*Primary Examiner* — Brad Harcourt
(74) *Attorney, Agent, or Firm* — Cantor Colburn LLP

(57) ABSTRACT

A method for communicating in a borehole includes running a pipe or tubing into a borehole the pipe or tubing conveying a sensor, running a wireline through the pipe or tubing, connecting the wireline with the sensor, attaching a converter sub to the pipe or tubing, communicating to surface information on the wireline in a method different than wireline.

19 Claims, 4 Drawing Sheets

PIPE CONVEYED LOGGING AND DRILL PIPE COMMUNICATION INTEGRATION SYSTEM AND METHOD

BACKGROUND

Pipe Conveyed Logging or Tubing Conveyed Logging are commonly employed methods for running and using logging tools in a borehole. Each utilizes a pipe or tubing string to convey the logging tools to a target depth, whether that be a casing shoe or other location. Such systems utilize a side entry sub that is positioned within the pipe or tubing string to be just uphole of the blow out preventer (BOP). Wireline that runs inside the pipe or tubing string downhole of the BOP to connect to the logging tools passes through the side entry sub and continues to surface in an annular space between the pipe or tubing string and wall of the borehole. As will be recognized by those familiar with the art, the wireline is at risk over its length in the annular space and potentially suffers the additional indignity of being yanked due to surge in a floating platform. A severed wireline in such position can be detrimental to the operation of the BOP since the severed wireline would tend to fall downhole and collect on top of the BOP. Recovery operations for a wireline in this condition are of course costly and delay planned borehole activities. Accordingly, the art would well receive improved methods and systems.

SUMMARY

A method for communicating in a borehole includes running a pipe or tubing into a borehole, the pipe or tubing conveying a sensor, running a wireline through the pipe or tubing, connecting the wireline with the sensor, attaching a converter sub to the pipe or tubing, communicating to surface information on the wireline in a method different than wireline.

A converter sub includes a communication and hanging system to secure a wireline to the sub, a decoder in signal communication with the wireline, and an encoder in signal communication with the decoder.

A method for logging includes running a string with logging equipment thereon and a wet connect, running wireline into the string, attaching a converter sub to the string and wireline, and attaching a wired pipe to the converter sub.

A borehole system includes a borehole in a subsurface formation, a length of tubular string in the borehole, a sensor at an end of the string distal from a surface location, a converter sub in the string at an end opposite the sensor, a wireline extending in the string from the sensor to the converter sub, and a communication configuration from the converter sub different than a wireline communication configuration.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
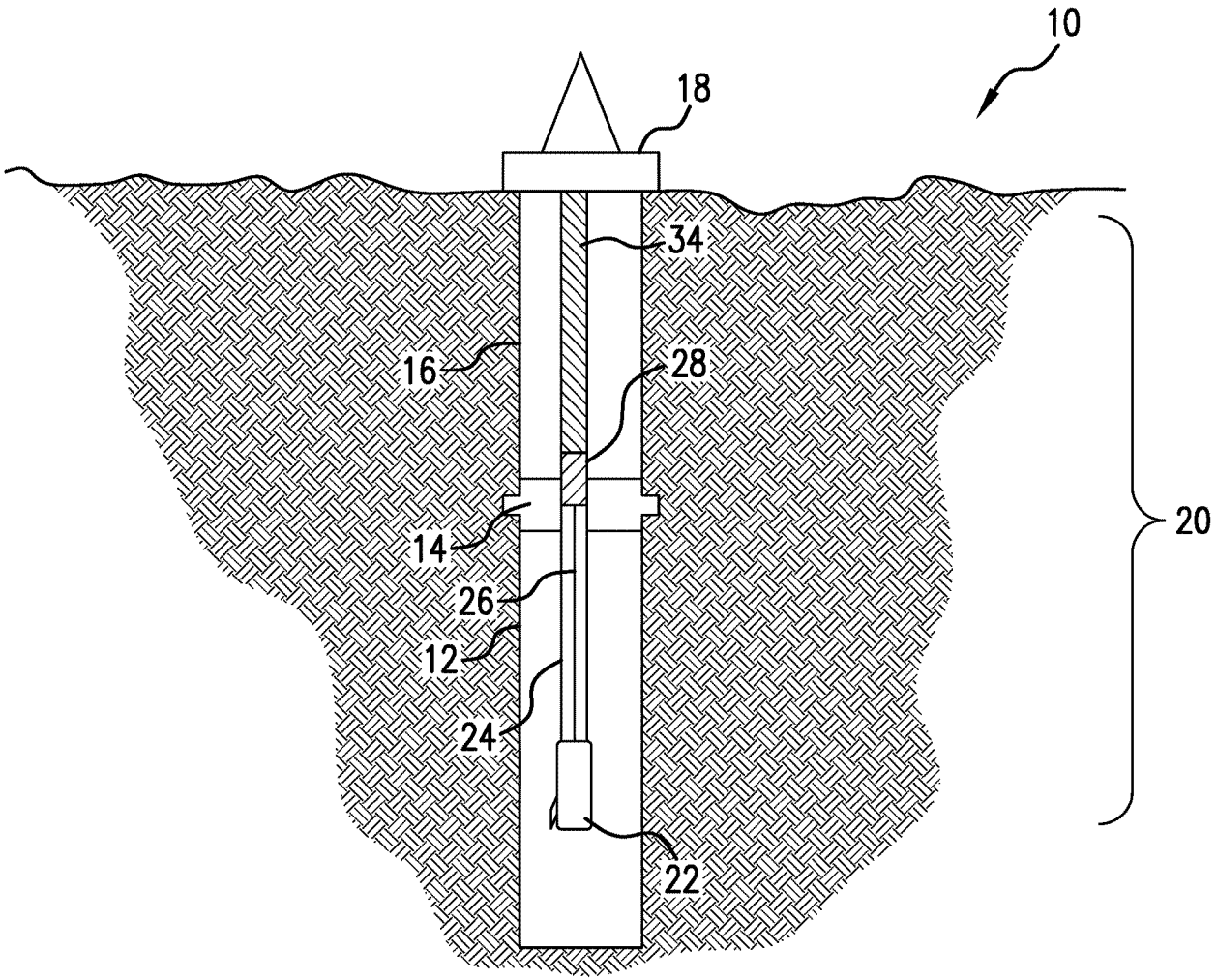
FIG. 1 is a schematic view of a borehole system in accordance with an embodiment as disclosure herein.

Referring to FIG. 1, a schematic view of a borehole system 10 configured according to the teachings hereof is illustrated. The system 10 includes a borehole 12, a BOP 14, a riser 16, a rig 18. The system further includes a telemetry system 20 comprising a sensor 22 such as logging equipment (one or more logging tools) a tubular string 24 (pipe, tubing) connected to the logging equipment 22, a wireline 26 disposed within the string 24 and communicatively connected to the logging equipment 22. The wireline 26 is terminated at a converter sub 28 where, referring to FIG. 2, a decoder 30 receives information from the wireline 26. The decoder 30 is informationally connected to an encoder 32 that may also be a part of the converter sub 28. The encoder 32 may be configured to encode different types of signals as desired simply by selecting a desired commercially available encoder. In FIG. 1, the encoder 32 is for wired pipe telemetry as a wired pipe 34 is illustrated connected to the converter sub 28. Wired pipe 34 then extends the length of the riser 16 to terminate at the rig 18 where information from the wired pipe 34 is provided to surface personnel.

The method to implement the embodiment described above, includes disposing the logging equipment 22 on a first joint of the tubular string 24 along with a wet connect, not shown but well known. Further joints of tubular string are added in known manner until the logging equipment 22 reaches a target depth just above a zone of interest in borehole 12. This may be a casing shoe or other location. At this point, the wireline 26 is run through the ID (inside dimension) of the tubular string 24 and wet connected to the logging equipment through the wet connect. Communication with the logging equipment 22 is verified and then the wireline is clamped off into the tubular string 24 in order to install the converter sub 28. With the converter sub installed the system is prepared to communicate to surface information on the wireline in a method different than wireline.

Figure 2:
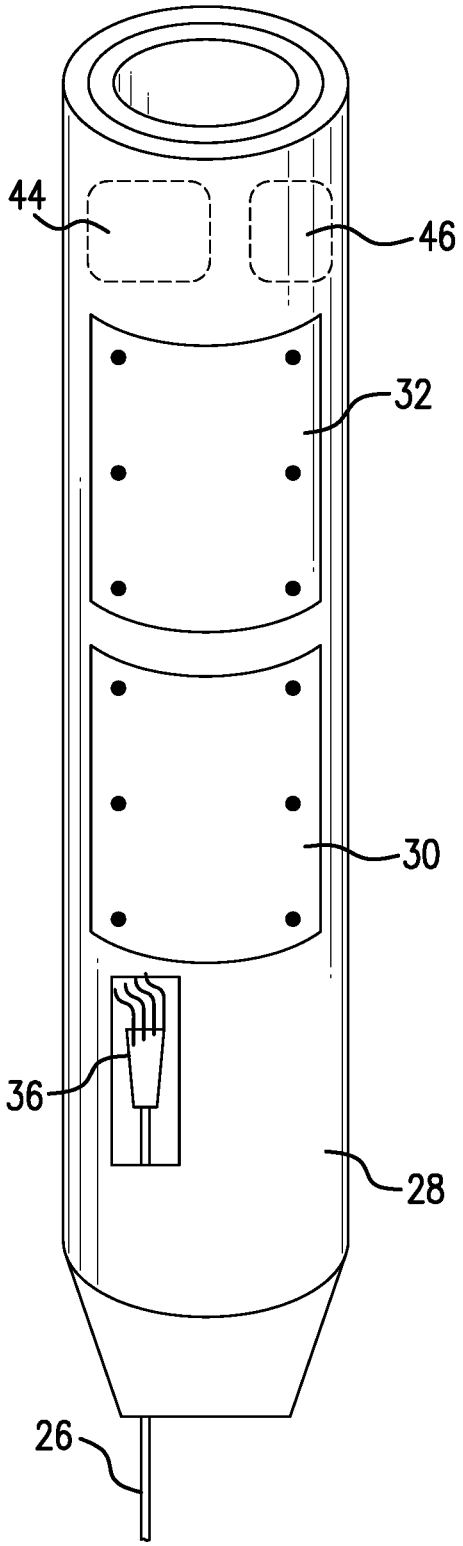
FIG. 2 is a schematic representation of one embodiment of a converter sub as disclosed herein.
Figure 3:
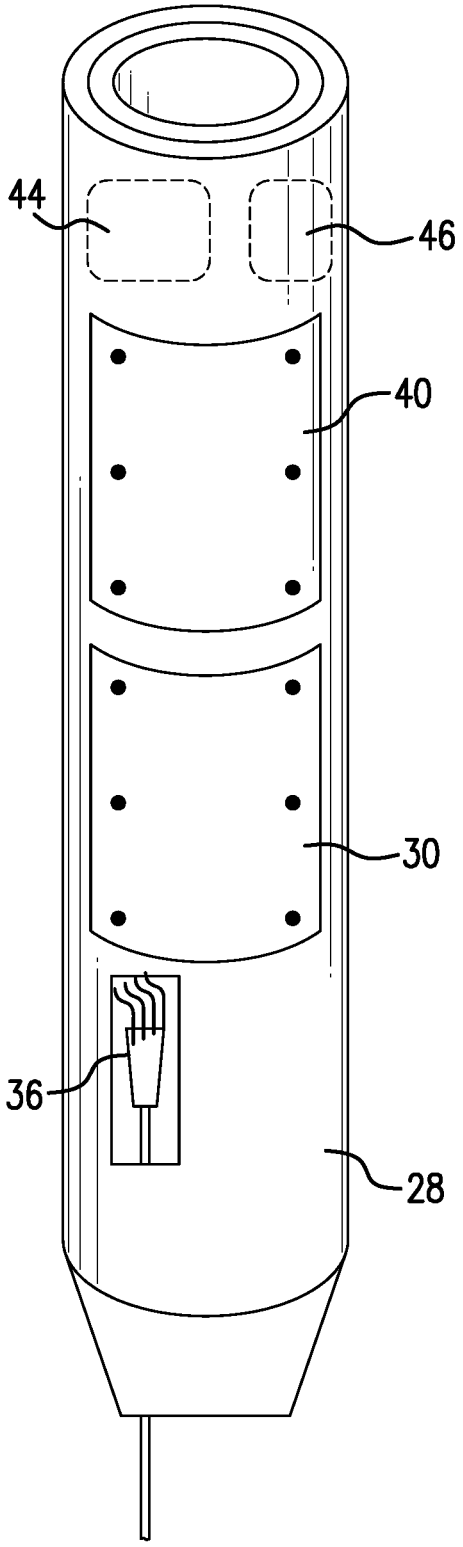
FIG. 3 is a schematic representation of another embodiment of a converter sub as disclosed herein.
Figure 4:
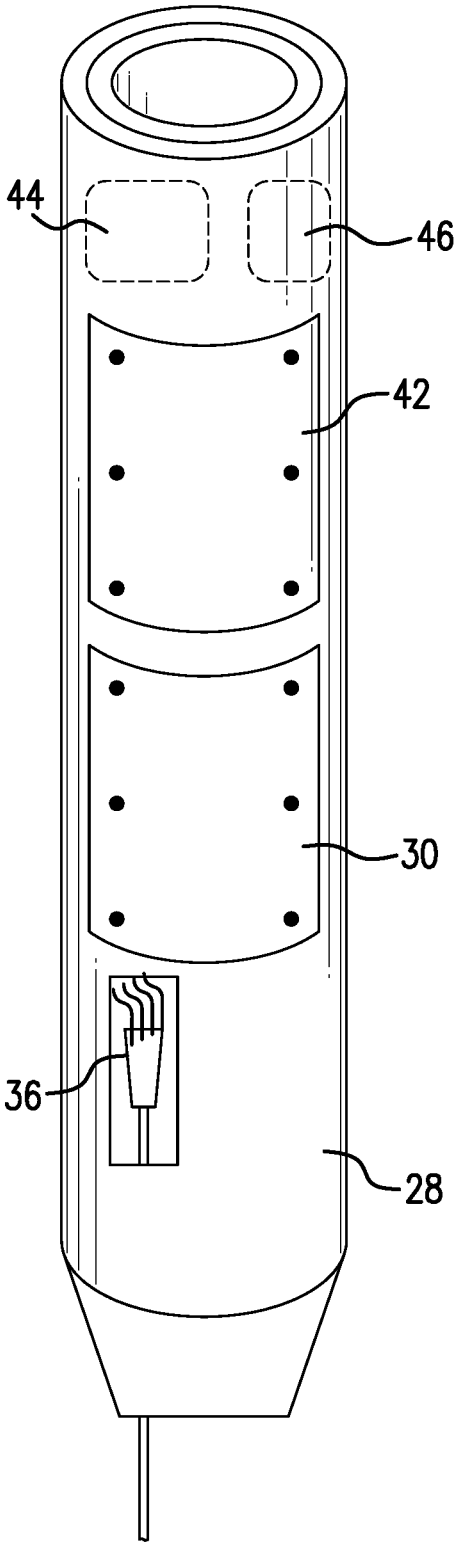
FIG. 4 is a schematic representation of yet another embodiment of a converter sub as disclosed herein.

Referring to FIG. 2, part of the converter sub 28 includes a communication and hanging system 36 such as, for example, a cone and basket hanging system available from Baker Hughes Incorporated Houston Tex. under part numbers A1001844000 (basket, torpedo downhole), A1000719000 (inner cone), 10076831 (outer cone), A1001845000 (basket, torpedo uphole) or a clamp hanging system available from Baker Hughes Incorporated Houston Tex. under part number A2000078484 to hang and effect communication with the wireline 26. The system 36 facilitates interconnection of the wireline 26 with the wireline decoder 30. Signals decoded by wireline decoder 30 are processed to be received by encoder 32, which in the case of FIG. 1, is a wired pipe encoder but it will be understood that any encoder is contemplated for use in this system. It is noted that FIGS. 3 and 4 illustrate alternative embodiments where the encoder 32 is different (FIG. 3 includes a mud pulse telemetry configuration 40 and FIG. 4 includes an acoustic ping telemetry configuration 42) such that a different signal may be passed uphole from the converter sub 28. It is further to be understood that although the decoder 30 and encoder 32 are illustrated as different components, this is only for clarity and the encoding and decoding can be achieved in a single module or more than one module as desired. Further, in some embodiments, a power source 44 may be provided in the converter sub 28. The source may be a battery, a turbine, etc. Additionally, in some iterations, a memory 46 may be provided in the converter sub 28 as a backup. Once the converter sub 28 is installed, logging may start and as the string is lengthened, and in the case of FIG. 1, additional joints of wired pipe are added at surface to extend the string 24 deeper into the borehole 12 to perform the logging operation.

The telemetry system 20 being a hybrid of inexpensive tubing string and wireline components deeper in the borehole and an alternate communication mechanism for portions of the system uphole of the BOP avoids the issues surrounding wireline run above a BOP in an annulus while maintaining the ability to communicate logging information uphole to surface. And in the case of the FIG. 1 embodiment, the hybrid system 20 reduces the length of wired pipe required for a telemetry system that otherwise would have to be formed entirely of wired pipe thereby significantly reducing cost over such a prior art telemetry system.

Set forth below are some embodiments of the foregoing disclosure:

Embodiment 1

A method for communicating in a borehole includes running a pipe or tubing into a borehole the pipe or tubing conveying a sensor, running a wireline through the pipe or tubing, connecting the wireline with the sensor, attaching a converter sub to the pipe or tubing, communicating to surface information on the wireline in a method different than wireline.

Embodiment 2

The method as in any prior embodiment wherein the sensor is logging equipment.

Embodiment 3

The method as in any prior embodiment wherein the communicating is decoding from wireline and encoding to the method different than wireline.

Embodiment 4

The method as in any prior embodiment wherein the method different that wireline is wired pipe.

Embodiment 5

The method as in any prior embodiment wherein the method different than wireline is mud pulse telemetry.

Embodiment 6

The method as in any prior embodiment wherein the method different that wireline is acoustic ping telemetry.

Embodiment 7

A converter sub includes a communication and hanging system to secure a wireline to the sub, a decoder in signal communication with the wireline, and an encoder in signal communication with the decoder.

Embodiment 8

The converter sub as in any prior embodiment wherein the communication and hanging system is a cone and basket hanging system.

Embodiment 9

The converter sub as in any prior embodiment wherein the communication and hanging system is a clamp hanging system.

Embodiment 10

The converter sub as in any prior embodiment further comprising a wired pipe connection.

Embodiment 11

The converter sub as in any prior embodiment further comprising a mud pulse telemetry configuration.

Embodiment 12

The converter sub as in any prior embodiment further comprising an acoustic ping telemetry configuration.

Embodiment 13

A method for logging includes running a string with logging equipment thereon and a wet connect, running wireline into the string, attaching a converter sub to the string and wireline, and attaching a wired pipe to the converter sub.

Embodiment 14

The method as in any prior embodiment further comprising converting wireline information to wired pipe information in the converter sub and conveying the information to surface.

Embodiment 15

A borehole system includes a borehole in a subsurface formation, a length of tubular string in the borehole, a sensor at an end of the string distal from a surface location, a converter sub in the string at an end opposite the sensor, a wireline extending in the string from the sensor to the converter sub, and a communication configuration from the converter sub different than a wireline communication configuration.

Embodiment 16

The borehole system as in any prior embodiment wherein the sensor is logging equipment.

Embodiment 17

The borehole system as in any prior embodiment wherein the converter sub includes a wireline communication and hanging system.

Embodiment 18

The borehole system in any prior embodiment wherein the converter sub includes conversion configurations for communicating wireline information to information conveyable by a communication means different than wireline.

Embodiment 19

The borehole system as in any prior embodiment wherein the communication configuration is wired pipe.

Embodiment 20

The borehole system as in any prior embodiment wherein the communication configuration is mud pulse telemetry.

Embodiment 21

The borehole system as in any prior embodiment wherein the communication configuration is acoustic ping telemetry.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for communicating logging information in a borehole comprising:

running a pipe or tubing into a borehole, the pipe or tubing conveying a sensor;

running a wireline through the pipe or tubing;

physically electrically connecting the wireline with the sensor;

attaching a converter sub to the pipe or tubing;

logging the borehole;

lengthening the pipe or tubing while logging; and communicating to surface information on the wireline in a method different than wireline.

2. The method as claimed in claim 1, wherein the sensor is logging equipment.

3. The method as claimed in claim 1, wherein the communicating is decoding from wireline and encoding to the method different than wireline.

4. The method as claimed in claim 3, wherein the method different that wireline is wired pipe.

5. The method as claimed in claim 3, wherein the method different than wireline is mud pulse telemetry.

6. The method as claimed in claim 3, wherein the method different that wireline is acoustic ping telemetry.

7. A borehole system comprising:

a borehole in a subsurface formation;

a length of tubular string in the borehole;

a sensor at an end of the string distal from a surface location;

a converter sub in the string at an end opposite the sensor;

a wireline extending in the string from the sensor to the converter sub, the wireline extending only downhole of the converter sub; and a communication configuration extending uphole from the converter sub different than a wireline communication configuration.

8. The borehole system as claimed in claim 7, wherein the sensor is logging equipment.

9. The borehole system as claimed in claim 7, wherein the converter sub includes a wireline communication and hanging system.

10. The borehole system as claimed in claim 7, wherein the converter sub includes conversion configurations for communicating wireline information to information conveyable by a communication means different than wireline.

11. The borehole system as claimed in claim 7, wherein the communication configuration is wired pipe.

12. The borehole system as claimed in claim 7, wherein the communication configuration is mud pulse telemetry.

13. The borehole system as claimed in claim 7, wherein the communication configuration is acoustic ping telemetry.

14. A borehole system as claimed in claim 7 wherein the converter sub includes:

a communication and hanging system to secure a wireline to the sub, the wireline extending only downhole from the sub;

a decoder in signal communication with the wireline; and an encoder in signal communication with the decoder.

15. The converter sub as claimed in claim 14, wherein the communication and hanging system is a cone and basket hanging system.

16. The converter sub as claimed in claim 14, wherein the communication and hanging system is a clamp hanging system.

17. The converter sub as claimed in claim 14, further comprising a wired pipe connection.

18. The converter sub as claimed in claim 14, further comprising a mud pulse telemetry configuration.

19. The converter sub as claimed in claim 14, further comprising an acoustic ping telemetry configuration.

* * * * *